US009039001B2

(12) United States Patent
Haeuselmann

(10) Patent No.: US 9,039,001 B2
(45) Date of Patent: May 26, 2015

(54) DEVICE FOR CLEANING BAKING TRAYS

(75) Inventor: Marcel Haeuselmann, Muehleberg (CH)

(73) Assignee: Marcel Hauselmann, Ulmiz (CH)

( * ) Notice: Subject to any disclaimer, the term of this patent is extended or adjusted under 35 U.S.C. 154(b) by 35 days.

(21) Appl. No.: 13/505,665

(22) PCT Filed: Oct. 20, 2010

(86) PCT No.: PCT/CH2010/000267

§ 371 (c)(1),
(2), (4) Date: Jun. 21, 2012

(87) PCT Pub. No.: WO2011/054116

PCT Pub. Date: May 12, 2011

(65) Prior Publication Data

US 2012/0267840 A1 Oct. 25, 2012

(30) Foreign Application Priority Data

Nov. 3, 2009 (CH) ..... 1694/09

(51) Int. Cl.

| | |
|---|---|
| ***B23Q 3/00*** | (2006.01) |
| ***A47G 19/08*** | (2006.01) |
| ***B65D 1/34*** | (2006.01) |
| ***A47L 17/02*** | (2006.01) |
| ***A47L 19/04*** | (2006.01) |

(52) U.S. Cl.
CPC *A47L 17/02* (2013.01); *A47L 19/04* (2013.01)

(58) Field of Classification Search
USPC ..... 269/296
See application file for complete search history.

(56) References Cited

U.S. PATENT DOCUMENTS

| | | | | | |
|---|---|---|---|---|---|
| 499,951 | A | * | 6/1893 | Baird | 220/572 |
| 1,059,350 | A | * | 4/1913 | Cockins | 220/572 |
| 1,226,993 | A | | 5/1917 | Perkins | |
| 1,371,253 | A | * | 3/1921 | Lynch | 220/572 |
| 1,466,514 | A | * | 8/1923 | Smythe | 211/41.4 |
| 1,622,909 | A | | 3/1927 | Hatcher | |
| 2,562,982 | A | * | 8/1951 | Cieri | 211/41.6 |
| 3,050,073 | A | | 8/1962 | McMillan | |
| 3,199,438 | A | * | 8/1965 | Myler et al. | 99/421 R |
| 3,742,965 | A | * | 7/1973 | Hudziak | 134/92 |
| 3,800,957 | A | * | 4/1974 | Krause | 211/41.3 |
| 4,476,848 | A | | 10/1984 | Protas | |
| 4,531,641 | A | * | 7/1985 | Archambault | 211/41.3 |
| 5,119,943 | A | * | 6/1992 | Hoang | 211/41.3 |
| D353,921 | S | * | 12/1994 | Lippisch et al. | D32/55 |
| 5,385,261 | A | * | 1/1995 | Lippisch et al. | 220/572 |
| 5,485,927 | A | * | 1/1996 | Hubbard | 211/41.3 |
| D397,534 | S | * | 8/1998 | Alvarez | D32/55 |
| D398,725 | S | * | 9/1998 | Merkel | D32/55 |

(Continued)

FOREIGN PATENT DOCUMENTS

| | | | | |
|---|---|---|---|---|
| GB | 290546 | | 0/1928 | |
| GB | 2444901 | A * | 6/2008 | A47L 19/04 |

*Primary Examiner* — Lee D Wilson
*Assistant Examiner* — Alvin Grant
(74) *Attorney, Agent, or Firm* — Birch, Stewart, Kolasch & Birch, LLP

(57) ABSTRACT

A device for cleaning trays comprises a tub that has a bottom and a wall. The tub is dimensioned such that a baking tray can be placed therein. The device further comprises a dish drain that can be placed in the tub. Said device for cleaning a baking tray uses only a small amount of space in a kitchen and is easy to handle. In fact, in a typical kitchen that already has a dish drain, the device requires no additional space.

14 Claims, 3 Drawing Sheets

(56) References Cited

U.S. PATENT DOCUMENTS

| | | | | |
|---|---|---|---|---|
| 6,179,134 | B1 * | 1/2001 | Pine et al. | 211/41.3 |
| 6,502,704 | B2 * | 1/2003 | Martorella et al. | 211/41.6 |
| 6,763,954 | B1 * | 7/2004 | Travers et al. | 211/41.3 |
| D532,948 | S * | 11/2006 | Gillisie | D32/55 |
| D555,311 | S * | 11/2007 | Yang et al. | D32/55 |
| 7,455,184 | B2 * | 11/2008 | Yang et al. | 211/41.4 |
| 7,669,721 | B2 * | 3/2010 | Kemper et al. | 211/41.3 |
| 7,735,661 | B1 * | 6/2010 | Sumner et al. | 211/41.3 |
| 8,127,942 | B2 * | 3/2012 | Meshkinfam | 211/41.3 |
| D683,504 | S * | 5/2013 | Clores | D32/3 |
| D688,426 | S * | 8/2013 | Clores | D32/3 |
| D690,069 | S * | 9/2013 | Sofy et al. | D32/55 |
| D704,511 | S * | 5/2014 | Beckman et al. | D7/552.2 |
| 2004/0238464 | A1 * | 12/2004 | Cheung | 211/41.3 |
| 2006/0169652 | A1 * | 8/2006 | Yang et al. | 211/41.3 |
| 2009/0152218 | A1 * | 6/2009 | Yang et al. | 211/41.4 |
| 2010/0012601 | A1 * | 1/2010 | Meshkinfam | 211/41.3 |
| 2010/0059460 | A1 * | 3/2010 | Mulaw | 211/41.3 |
| 2012/0085715 | A1 * | 4/2012 | Yang et al. | 211/41.4 |

* cited by examiner

DEVICE FOR CLEANING BAKING TRAYS

TECHNICAL FIELD

The invention relates to a device for cleaning baking trays, comprising a tub with a tub base and tub wall, wherein the tub is dimensioned in such a manner that a baking tray is placeable into the tub.

PRIOR ART

The problems of washing baking trays and baking sheets, etc. are well known to the commercial or private user thereof. Typical baking trays have dimensions which exceed those of customary sinks. In order to wash the baking trays, the latter are guided obliquely into the sink and scrubbed with suitable cleaning utensils, such as a sponge, brush and the like and with cleaning agents. However, only approx. the lower half, which is located below the tap, can be reached and therefore the baking tray subsequently has to be rotated in order to be able to clean the second half thereof. By means of this rotating operation of the half washed baking tray, a region around the sink is frequently soiled, in particular by the less skilled cleaner, and therefore, after the baking tray has been cleaned, the depositing area next to the sink and/or the kitchen floor also has to be cleaned. Furthermore, the cleaning of the baking trays is made difficult by charred or caked residues of the baked foodstuffs frequently sticking after the baking process to the baking tray and not being readily removable. In this case, of course, the experienced person knows that, in order to optimize the washing operation of the baking tray, the latter can be filled in advance with water and/or cleaning agent so that the adhering dirt is softened and starts to dissolve. However, there is the matter in this case of where the filled baking tray can be put without getting into the way of further actions in the kitchen.

The present cleaning methods of baking trays therefore have the disadvantage that they take up a relatively large amount of space for the soaking operation and the handling of the baking trays is unwieldy during washing, thus frequently resulting in an increased need to clean the surroundings of a sink.

SUMMARY OF THE INVENTION

It is the object of the invention to provide a device for cleaning baking trays, which device belongs to the technical field mentioned at the beginning, is of simple and space-saving design and is ergonomic to handle.

The object is achieved by the features of claim 1. According to the invention, the device comprises a drainage rack which is insertable into the tub.

The effect achieved by the drainage rack which is insertable into the tub is that the device can be deposited on a depositing area next to the sink in a typical kitchen without requiring additional space. Most kitchens namely already make use of drainage racks in order, after rinsing, to allow the wet objects, such as, for example, dishes, cutlery, pans, etc., to drain thereon. The present invention now makes provision to provide a tub, in which there is space for a baking tray, under said draining rack.

For this purpose, the drainage rack can be configured in a manner known to a person skilled in the art. Typical drainage racks comprise, for example, holders for plates, with which said holders can be deposited substantially vertically and the formation of spots of lime can be substantially prevented. Furthermore, a depositing surface for pans and the like and one for cutlery are preferably also provided. For the cutlery, a container which is connected to the drainage rack or a separate container, in which the cutlery can be arranged vertically such that the water can optimally drain away, can also be provided. For this purpose, the drainage rack may be formed from plastic and comprise at least one opening such that the drained water can drain away. The drainage rack preferably has, however, a plurality of regularly distributed openings (for example in the manner of a sieve). The drainage rack may be substantially in the form of a tub. Furthermore, the drainage rack may also be constructed as a wire formation or from wood.

In order now to wash a baking tray, the drainage rack can be removed from the tub and the tub can be filled with water and optionally with the addition of a cleaning agent. The baking tray (or another flat object to be cleaned, for example a grill rack) can subsequently be placed into the tub such that dirt (charred foodstuff residues, grease, oils, etc.) can be dissolved from the baking tray. The tub can subsequently be emptied and filled with fresh water and cleaning agent. The baking tray can then be cleaned in the tub by means of additional cleaning utensils (sponge, brush, steel wool, etc.). After the tub has been emptied and rinsed out, the drainage rack can be inserted again into the tub. The base of the tub is preferably of a size permitting the baking tray to be placed therein, wherein there is a sufficient amount of space such that the circumference of the baking tray can also easily be grasped.

The drainage rack is preferably insertable into the tub in a first and a second orientation, wherein, in the first orientation, the drainage rack is raised with respect to the second orientation. The effect achieved by this is that the baking tray can be placed into the tub, in particular with the tub filled, in order to soak the baking tray and at the same time the drainage rack can be inserted into the tub. As a result, the drainage rack can continue to be used during the soaking of the baking tray while no additional space is required for soaking the baking tray. Even with the tub filled with washing water and the baking tray placed therein, the drainage rack, in the first, raised orientation, does not drop into the washing water, and therefore soiling of the drainage rack and of the object to be drained can be prevented. When the tub is not filled, the drainage rack is preferably inserted into the tub in the second orientation, in particular since, as a result, the center of gravity of the tub/drainage rack arrangement is located at a lower level and a more stable state is thus achieved and since easier fillability of the drainage rack thus results. This is advantageous particularly if heavy objects are deposited on the drainage rack. The drainage rack is preferably rotated through 180° about a vertical axis with respect to the two orientations to the tub. Of course, the tub may also be rotated through 180° about a vertical axis with respect to the drainage rack in order to change between the first and second orientation. Particularly if the tub and the drainage rack have a square area, it is also conceivable for the orientations to differ by a rotation through 90° about a vertical axis.

As an alternative, the tub and/or the drainage rack may also be designed in such a manner that the drainage rack can be arranged only at one height. In this case, the drainage rack may nevertheless be inserted rotated through 180° about a vertical axis into the tub. However, in this case, the inserted drainage rack is preferably arranged at such a height that the baking tray, even with the drainage rack placed thereon, can be soaked in the tub located therebelow.

In the first orientation, the drainage rack preferably rests on supports. In the first orientation, the drainage rack may rest on supports and, in the second orientation, may not rest on supports. In particular, in the second orientation, the drainage rack may rest on the tub base, thus enabling a larger bearing surface and therefore a more stable state of the drainage rack to be achieved. The drainage rack has matching recesses or upwardly directed bulges such that, in the first orientation, said drainage rack rests on the supports and, in the second orientation, the supports come to lie in the matching recesses or bulges of the drainage rack.

For this purpose, the tub preferably comprises at least three, in particular at least four supports such that the drainage rack can rest in a stable manner on the supports even in the event of nonuniformly distributed loads caused by the objects being drained. The supports may be arranged in such a manner that they are arranged symmetrically with respect to a horizontal plane and are arranged nonsymmetrically with respect to a further plane lying at a right angle to said plane. The supports are furthermore arranged in such a manner that a baking tray comes to lie between the supports.

Of course, the supports may also be oriented in any other manner, but care should be taken to ensure that the drainage rack can be inserted into the tub in two orientations, wherein the drainage rack comes to lie on the supports in precisely one orientation.

The supports are preferably designed as bulges in the tub wall and/or in the tub base. This permits a particularly simple production process, since the tub and the bulges can be produced as a single piece. The supports are preferably provided as bulges in the region of the tub wall such that the baking tray does not rest on the supports.

The tub preferably has a substantially rectangular basic shape. For example, bulges can be present at two adjacent corners of the tub wall, wherein two further bulges are present between the two further corners of the tub wall. It is clear to a person skilled in the art that any number of arrangements of the bulges are conceivable for fulfilling the purpose of the drainage rack, in a first orientation, being raised in relation to a second orientation.

As an alternative, the supports may also be designed in a different manner. For example, supports may be produced separately and fastened in the tub. For the fastening, a series of options are known to a person skilled in the art. For example, the supports could be adhesively bonded, introduced by means of a clip connection or screwed on. However, it should be noted that the outlay on production is greater if the tub and the supports are not formed as a single piece.

The tub preferably comprises an outlet opening. The emptying of the tub is thereby facilitated. In particular, the tub which is filled with washing liquid does not have to be raised for emptying, thus enabling emptying to be more ergonomic.

As an alternative, the outlet opening may also be omitted. For the emptying, the tub is then tilted until the washing liquid can drain out.

The outlet opening is preferably closeable. For this purpose, the outlet opening can be provided in the tub base and is closeable, for example, by means of a screw closure or a bung, in particular a plastic or cork bung.

As an alternative, it is also possible to dispense with making the outlet opening closeable by the outlet opening being spaced apart upwards with respect to the tub base. The outlet opening can thus be provided, for example, as a spout or discharge opening. However, in this case, in order to empty the tub, the latter would have to be raised at a region opposite the spout.

The outlet opening is preferably designed as an overflow. In this case, the overflow may be designed as a tubular element which is connected to an opening in the tub base. This has the advantage that the tub cannot be overfilled since, at too high a level, the water automatically drains off through the overflow.

Of course, an outlet opening may also be provided in addition to the overflow. As an alternative, the overflow may also be omitted.

The overflow is preferably designed to be removable. By removal of the tubular element, the tub can thereby be emptied again in a simple manner. As a result, the overflow can additionally take on the function of a closure.

As an alternative, the overflow may also be connected fixedly to the tub.

The outlet opening is preferably arranged in a transition region between the tub base and the tub wall of the tub, in particular centrally with respect to a tub side. This enables the washing water to be able to drain away into the sink in a simple manner. For this purpose, the tub can namely be pushed with the tub side containing the outlet opening over the sink in order to allow the washing water to drain away directly into the sink. If the tub base is raised in the region of the outlet opening with respect to the resting area next to the sink, the displacement of the tub in the direction of the sink may also be omitted, but the washing water at least partially drains away over the resting area and may contaminate the latter. Furthermore, the outlet opening may also be actuated, i.e. opened or closed, as a result with the baking tray inserted. The tub base preferably has a convex shape in a vertical section in the direction of the outflow such that the washing water can optimally drain away.

As an alternative, the outlet opening may also be provided at a different location. For example, the outlet opening could also be provided in the center of the tub base, wherein the tub base drops towards the outlet opening, thus enabling complete emptying of the tub.

One tub side is preferably of convex design with respect to a horizontal cross section of the tub, in particular in the region of the outlet opening. This enables the outlet opening to be more easily accessible when the baking tray is inserted. Furthermore, for the emptying of the tub, displacement thereof in the direction of the sink can largely be omitted.

As an alternative, the above-described convex formation of the tub side may also be omitted.

The tub preferably has shape-stabilizing structures on the tub base. This has the advantage that the tub is more stable in relation to torsional forces. In particular, a stable and cost-effective tub can therefore be produced with little consumption of material and with a low weight. The bulges can be designed to be inclined toward the outlet opening in such a manner that, during the emptying of the tub, the washing liquid can drain away optimally. For this purpose, for example, elements can be provided on the inside and/or the outside of the tub base. Said elements may be connected integrally to the tub. Furthermore, the elements may also be adhesively bonded on or connected to the tub base in other ways known to a person skilled in the art.

As an alternative, the shape-stabilizing structures may also be omitted, in particular if the selected material is sufficiently stable or the selected material thickness is of a sufficient size.

The structures are preferably designed as bulges in the base. This has the advantage that the tub can be produced in a simple manner. Bulges of this type furthermore have the advantage that a baking tray has a smaller bearing surface in the tub, and therefore the soaking process can also take place at least partially on the underside of the baking tray. The bulges may in principle be of any shape. For example, they may be of round, oval, rectangular, triangular or polygonal design. However, the bulges are preferably of convex design, thus simplifying cleaning of the tub. The bulges may also be of rod-shaped design and arranged, in particular in a fan-shaped manner, around the outlet opening. The shape-stabilizing structures may also have an entirely positive effect on the aesthetic appearance of the tub.

As an alternative, the shape-stabilizing structures may also be formed within the tub base, wherein the tub base is designed in the manner of a sandwich. However, the outlay on production would be increased in this case.

The tub is preferably formed from plastic. The use of plastic has the advantage that the tub can be produced cost-effectively. Furthermore, a tub made of plastic is simple to clean and has a relatively low weight.

As an alternative, of course, other materials may also be used. However, the use of metals would lead to increased production costs and to a greater weight of the tub.

The tub is preferably produced by means of injection molding. Injection molding permits cost-effective and time-efficient production.

As an alternative, other production methods known to a person skilled in the art, for example a deep drawing method, may also be used. The production method also largely depends on the choice of material.

Further advantageous embodiments and combinations of features of the invention emerge from the detailed description below and the entirety of the patent claims.

BRIEF DESCRIPTION OF THE DRAWINGS

In the drawings used for explaining the exemplary embodiment.

In principle, identical parts are provided with the same reference numbers in the figures.

WAY OF IMPLEMENTING THE INVENTION

Figure 1A:
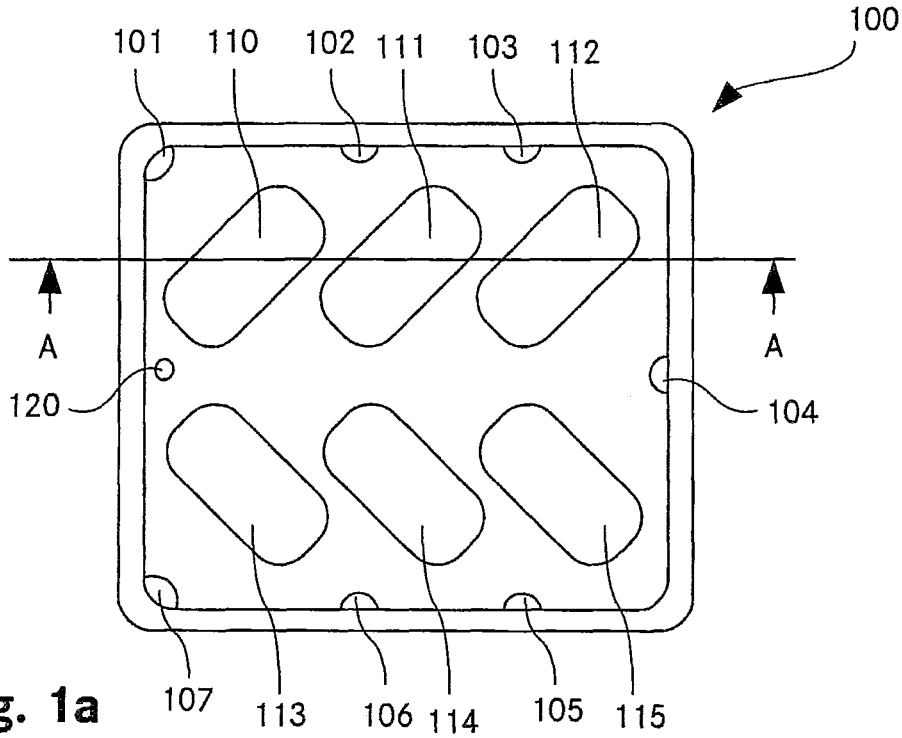
FIG. 1*a* shows a top view of a tub of a device according to the invention for cleaning baking trays.

FIG. 1*a* shows a possible embodiment of a tub 100 of a device according to the invention for cleaning baking trays, which tub comprises bulges 110-115 in the tub base and indentations 101-107 in the edge region, and also an outlet opening 120. The tub 100 essentially has a rectangular, non-square basic shape with a protruding edge. The protruding edge serves here for ergonomic grasping, for stability, as a bearing surface for a drainage rack (in particular in the second orientation) and for the aesthetic appearance of the tub 100. In the present embodiment, the tub 100 is composed of plastic, in particular of polyethylene, and is produced by means of injection molding.

In the present embodiment, the bulges 110-115 are designed as six rounded rectangles which are arranged in two parallel groups of three, wherein the rounded rectangles of the one group of three are oriented by +45° and the others by −45° with respect to a longitudinal axis of the tub 100. The bulges 110-115 serve to stabilize the tub and can additionally contribute to the aesthetics and/or recognition of the tub.

The indentations 101-107 in the edge region of the tub 100 serve as supports, on which the drainage rack 200 (not visible here) can rest, and are essentially designed as downwardly open semicircular cylinders. The indentations 101-107 are arranged symmetrically with respect to a first vertical plane which is oriented parallel to a longer side of the tub and are arranged nonsymmetrically with respect to a vertical plane which is oriented at a right angle with respect to the first plane. On the longer sides, an indentation 101 and 107 are in each case arranged at a first corner, wherein no indentations are provided at the second corner. Two further indentations 102, 103 and 106, 105 are in each case provided at a distance from the first corner, wherein there are no indentations at the same distance, as seen from the second corner. An outlet opening 120 is provided on a shorter side of the tub 100 centrally between the indentations 101 and 107, which outlet opening is closeable in the present embodiment by means of a bung (not illustrated). Opposite the outlet opening, a further indentation 104 is provided in the corresponding shorter side wall.

Figure 1B:
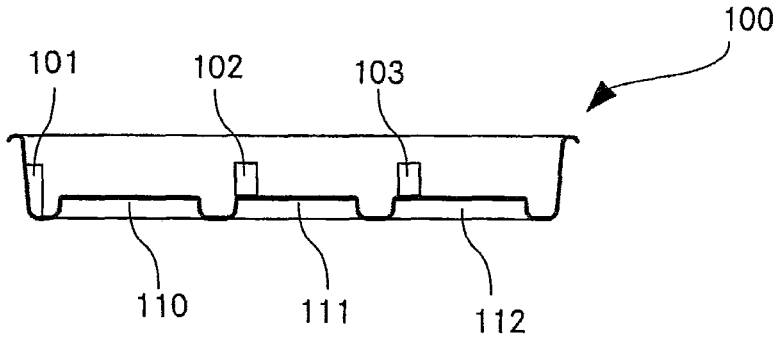
FIG. 1*b* shows a schematic illustration of a horizontal cross section of the tub along the line A-A in FIG. 1*a;*

FIG. 1*b* shows a schematic illustration of a horizontal cross section of the tub along the line A-A in FIG. 1*a*. The bulges 110-112 in the tub base and the indentations 101-103, which are provided for supporting the drainage rack (not visible) in the first orientation, are visible here.

Figure 2A:
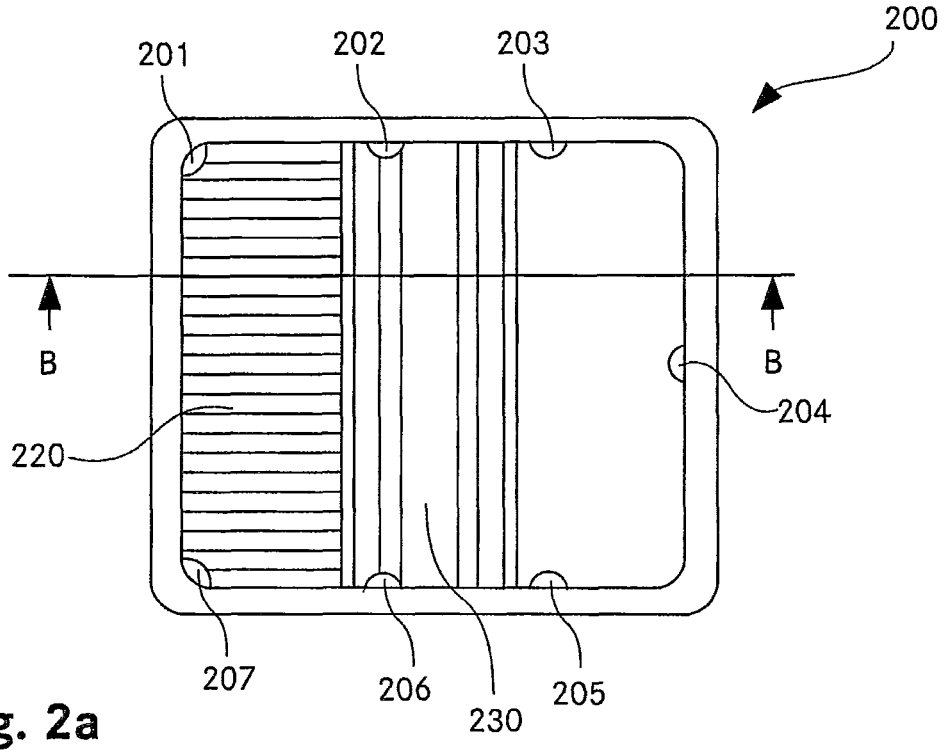
FIG. 2*a* shows a top view of a drainage rack.

FIG. 2*a* shows a top view of a drainage rack 200 which, in the present embodiment, consists of plastic, in particular, of polyethylene, and is produced by means of injection molding. The drainage rack 200 comprises indentations 201-207 which are arranged substantially congruently to the indentations 101-107 of the tub 100, but offset inwards slightly, in particular at least by a wall thickness of the drainage rack. The drainage rack 200 is dimensioned in such a manner that it can be inserted into the tub 100, i.e. the base of the drainage rack 200 has slightly smaller dimensions than the base of the tub 100. The drainage rack 200 furthermore also comprises a protruding edge which has a greater width than the protruding edge of the tub 100. In order to hold the articles to be drained, the drainage rack 200 comprises plate mounts 220 and a cutlery store 230. The plate mounts 220 are of curved design in a vertical cross section and have vertical slots for receiving the plates. The cutlery store 230 is designed as a raised platform with a wall on both sides. So that the water which is drained off can drain away, the drainage rack 200 has at least one opening (not illustrated). The drainage rack 200 preferably has an opening (in particular also in the cutlery store) at least at each locally lowest point.

Figure 2B:
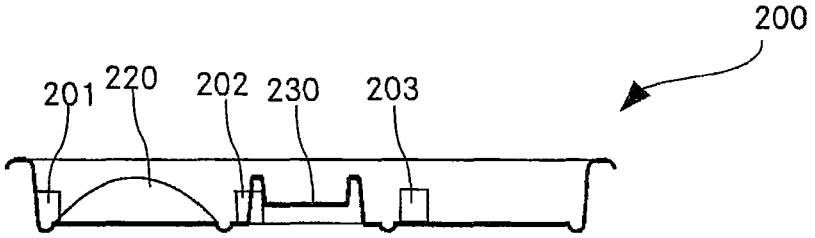
FIG. 2*b* shows a schematic illustration of a horizontal cross section of the drainage rack along the line B-B in FIG. 2*a;*

FIG. 2*b* shows a schematic illustration of a horizontal cross section of the drainage rack 200 along the line B-B in FIG. 2*a*. The indentations 201-203 and the curved plate mount 220 and the cutlery store 230 can be seen here.

Figure 3A:
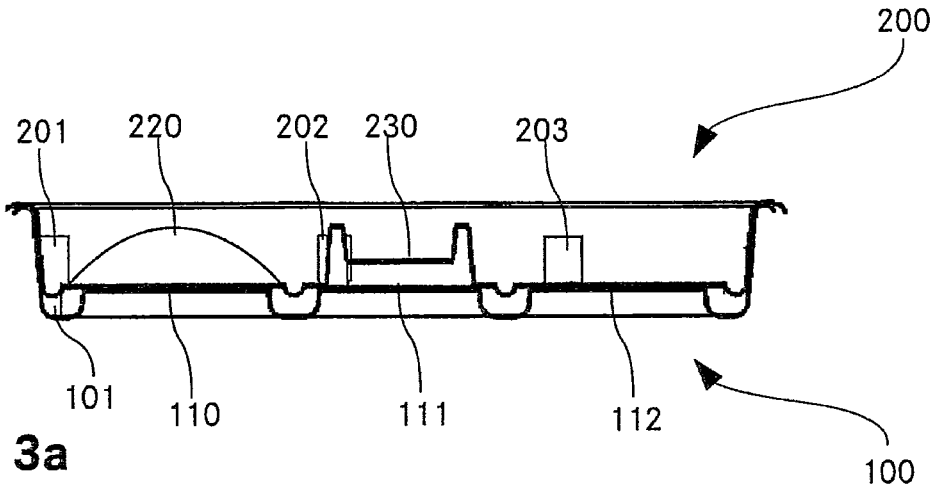
FIG. 3*a* shows a schematic illustration of a horizontal cross section of the arrangement of the tub and of the drainage rack in the second orientation.

FIG. 3*a* shows a schematic illustration of a horizontal cross section of the arrangement of the tub 100 and of the drainage rack 200 in the second orientation, wherein the drainage rack 200 does not rest on the indentations 101-107. However, only the indentation 101 is partially visible in FIG. 3*a*. Essentially, the drainage rack 200 according to FIG. 2*b* can be seen. Since the indentations 101-107 of the tub are of substantially congruent design with respect to the indentations 201-207 of the drainage rack, when the drainage rack is placed on in the first orientation, the indentations 201-207 of the drainage rack 200 are pushed in a fitting manner over the indentations 101-107, as a result of which the drainage rack 200 at least partially rests on the bulges 110-115 in the tub base. In this case, the indentation 201 and 202-207 of the drainage rack 200 are pushed over the indentations 101 and 102-107, respectively, of the tub. The protrusion of the drainage rack 200 covers the protrusion of the tub 100 here.

Figure 3B:
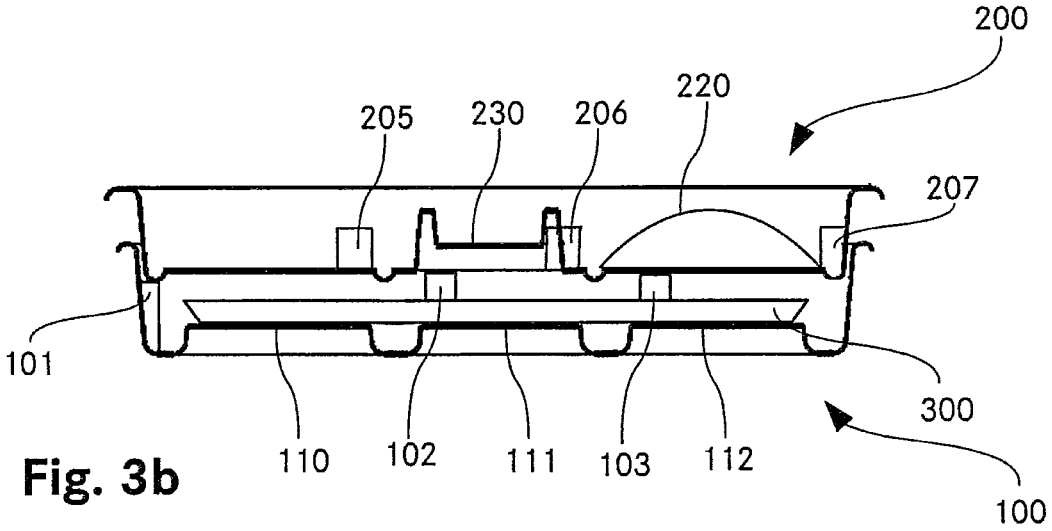
FIG. 3*b* shows a schematic illustration of a horizontal cross section of the arrangement of the tub and the drainage rack in the first orientation.

FIG. 3*a* shows a schematic illustration of a horizontal cross section of the arrangement of the tub 100 and of the drainage rack 200 in the first orientation, wherein the drainage rack 200 rests on the indentations 101-107 of the tub 100. For this purpose, the drainage rack 200 is rotated through 180° about a vertical axis with respect to the preceding figures. This can be seen in particular by the fact that the plate mount 220 is illustrated on the right in FIG. 3*b*. It can furthermore be seen in this figure that, for example, the indentation 102 of the tub 100 is not oriented below the indentation 205 of the drainage rack 200. The same also applies to the remaining indentations 101, 103-107 of the tub 100 and the indentations 201-204, 206, 207 of the drainage rack 200. It is therefore achieved that, in the first orientation, all of the indentations 101-107 can act as bearing surfaces for the drainage rack 200. Since, in the first orientation, the drainage rack 200 is raised with respect to the tub base of the tub 100, a baking tray 300 then has room in an intermediate space formed by the tub 100 and the drainage rack 200. Said baking tray rests between the indentations 201-207 and on the bulges 110-112.

When the tub 100 is not required, the arrangement according to FIG. 3*a* is preferably selected, wherein the drainage rack 200 can be used in a customary manner. If a dirty baking tray 300 is now to be cleaned, the drainage rack 200 can be removed from the tub 100 and the tub 100 can be filled with water and cleaning agent. The baking tray 300 is subsequently placed into the tub 100 and the drainage rack 200 placed on in the first orientation as per FIG. 3*b*. In this state, the drainage rack 200 can be used for the remaining washing-up, wherein no additional space is required for soaking the baking tray 300. After the end of the soaking process (in particular after the objects have been removed from the drainage rack 200), the drainage rack 200 can be lifted out of the tub 100 and the baking tray 300 washed in the tub 100 (or in the sink). After the washing-up has taken place, the outlet opening is opened, i.e., in the present embodiment, the bung is removed, and therefore the washing water can drain away. The tub wall preferably has a convex shape with respect to a horizontal section in the region of the outlet opening 120 such that the outlet opening 120 protrudes and comes to lie slightly over the sink. Soiling of the depositing surface under the tub 100 by the washing water can therefore be largely prevented. Of course, in order to empty the tub 100, the latter may also be pushed forwards in the direction of the sink such that the outlet opening 120 comes to lie over the sink.

The tub 100 and the drainage rack 200 may also be composed of different materials, in particular even of composite materials. For example, the drainage rack may be composed of wood or of a plastic-covered wire formation.

A different number of indentations 101-107 may also be provided. Different arrangements of the indentations may also be selected, but the tub is preferably formed with respect to a vertical plane so as to be parallel to a shorter side and asymmetrical centrally to a longer side.

As an alternative to the bung, other closures known to a person skilled in the art for the outlet opening 120 may also be provided. For example, a rotary closure or an insertable pipe, which may at the same time take over the function of an overflow, could also be provided.

So that the water which has drained off, can drain away, the drainage rack 200 may also be formed with a multiplicity of holes, in a manner similar to a colander (strainer).

In summary, it should be emphasized that the invention provides a device for cleaning baking trays, which device does not take up any additional space, can be produced cost-effectively and is simple to handle.

The invention claimed is:

1. A device for cleaning baking trays, comprising a tub with a tub base and a tub wall, wherein the tub is dimensioned in such a manner that a baking tray can be placed into the tub, and a drainage rack which can be inserted into the tub, characterized in that in a first orientation of the drainage rack inserted into the tub, the whole drainage rack is raised with respect to a second orientation of the drainage rack inserted into the tub, wherein the drainage rack includes matching recesses or upwardly directed bulges such that, in the first orientation, the drainage rack rests on supports and, in the second orientation, the supports lie beside the matching recesses or bulges of the drainage rack.

2. The device as claimed in claim 1, characterized in that the supports are designed as bulges in the tub wall.

3. The device as claimed in claim 1, characterized in that the tub comprises an outlet opening.

4. The device as claimed in claim 3, characterized in that the outlet opening is closed or opened.

5. The device as claimed in claim 3, characterized in that the outlet opening is designed as an overflow.

6. The device as claimed in claim 5, characterized in that the overflow is designed to be removable.

7. The device as claimed in claim 3, characterized in that the outlet opening is arranged in a transition region between the tub base and the tub wall of the tub, in particular centrally with respect to a tub side.

8. The device as claimed in claim 7, characterized in that one tub side is of convex design with respect to a horizontal cross section of the tub, in particular in the region of the outlet opening.

9. The device as claimed in claim 1, characterized in that the tub has shape-stabilizing structures on the tub base.

10. The device as claimed in claim 9, characterized in that the structures are designed as bulges in the base.

11. The device as claimed in claim 1, characterized in that the tub is formed from plastic.

12. The device as claimed in claim 1, characterized in that the supports are bulges in the tub wall, wherein the bulges in the tub are substantially congruent in design with respect to indentations of the drainage rack such that in the second orientation, the indentations of the drainage rack fit over the bulges of the tub.

13. The device as claimed in claim 1, characterized in that the supports are designed as bulges in the tub base.

14. The device as claimed in claim 1, characterized in that the supports are bulges in the tub base, wherein the bulges in the tub are substantially congruent in design with respect to indentations of the drainage rack such that in the second orientation, the indentations of the drainage rack fit over the bulges of the tub.

* * * * *